US005464268A

United States Patent [19]

Levrangi

[11] Patent Number: 5,464,268

[45] Date of Patent: Nov. 7, 1995

[54] ADJUSTABLE DECK-CHAIR WITH SPRING POSITIONING MEANS

[75] Inventor: Stefano Levrangi, Vestone, Italy

[73] Assignee: Fast S.p.A., Nozza de Vestone, Italy

[21] Appl. No.: 110,384

[22] Filed: Aug. 23, 1993

[30] Foreign Application Priority Data

Jul. 27, 1993 [IT] Italy ..... BS92U0080

[51] Int. Cl.[6] ..... A47C 4/26

[52] U.S. Cl. ..... 297/57; 297/19; 297/344.15; 248/164

[58] Field of Search ..... 297/57, 56, 55, 297/344.15, 344.12, 338, 19; 248/164

[56] References Cited

U.S. PATENT DOCUMENTS

| | | | |
|---|---|---|---|
| 2,732,006 | 1/1956 | Crescent | 297/344.15 X |
| 4,861,100 | 8/1989 | Baccaro | 297/19 |
| 4,906,042 | 3/1990 | Ollat | 297/19 |
| 5,165,755 | 11/1992 | Rho | 297/19 X |
| 5,330,253 | 7/1994 | Kaneko | 297/19 X |

FOREIGN PATENT DOCUMENTS

| | | | |
|---|---|---|---|
| 291091 | 4/1916 | Germany | 297/344.12 |
| 3322788 | 1/1984 | Germany | 297/19 |
| 1166736 | 7/1986 | Japan | 297/344.12 |
| 2678 | of 1865 | United Kingdom | 297/56 |
| 261774 | 1/1928 | United Kingdom | 297/344.12 |

*Primary Examiner*—Kenneth J. Dorner
*Assistant Examiner*—David E. Allred
*Attorney, Agent, or Firm*—McGlew and Tuttle

[57] ABSTRACT

A garden folding deck-chair comprising locking pins (18) designed to pass through rack-type toothings (17) in order to establish the various positions of the back and seat and corresponding different positions of use. A guide groove (19) is provided in proximity to each rack toothing (17), and each locking pin (18) is forced and guided in the said guide groove (19), in order to prevent any displacement of the toothing away from the pin.

7 Claims, 1 Drawing Sheet

ADJUSTABLE DECK-CHAIR WITH SPRING POSITIONING MEANS

FIELD OF THE INVENTION

The present invention relates to a garden deck-chair in metal, wood, synthetic resin or any other material, designed for being used in several positions by changing seat and back inclination, and then folded in order to make it compact for packing, transport and replacing after use.

BACKGROUND OF THE INVENTION

Such deck-chairs usually comprise rack-type toothings provided in or applied to both sides of the seat or back—however on opposite sides of the chair—and locking pins interacting with said toothings in order to establish the different positions of use of the deck-chair.

The known structures however are not free from disadvantages, which usually occur when choosing or changing position of use of the deck-chair. In fact, it may happen that the locking pins do not coincide with, and do not correctly pass through, the corresponding grooves, or that the locking pins have difficulties in positioning in the toothing when the parts of the deck-chair are reciprocally displaced for the desired position, or when a deck-chair is moved to another place.

SUMMARY AND OBJECTS OF THE INVENTION

It is an object of the present invention to obviate the aforementioned disadvantages by a new configuration and combination of the positioning means of the deck-chair, for use thereof in its various positions. The object proposed is achieved by providing the positioning means of the deck-chair, namely pins interacting with the rack toothing, with spring elements which cause locking of the seat and favour the choice of the most suitable position of use of the deck-chair.

BRIEF DESCRIPTION OF THE DRAWINGS

Further characteristics of the invention will become apparent from the following description, made with reference to the accompanying drawings in which.

DETAILED DESCRIPTION OF THE PREFERRED EMBODIMENT

Figure 1:
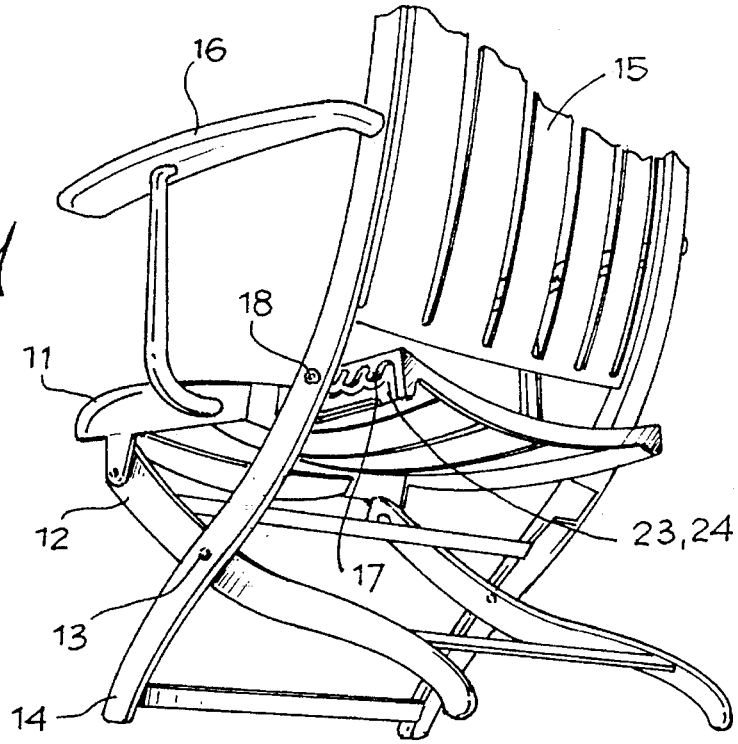
FIG. 1 is a perspective view of the deck-chair showing a rack toothing.

The deck-chair according to this invention—see FIG. 1—comprises a seat 11 pivoted in front at the top end of a first pair of legs 12, which cross and are pivotly connected, at point 13, to a second pair of legs 14 supporting the back 15 of the deck-chair. Arms 16 are pivotly connected to the said seat and back.

Figure 2:
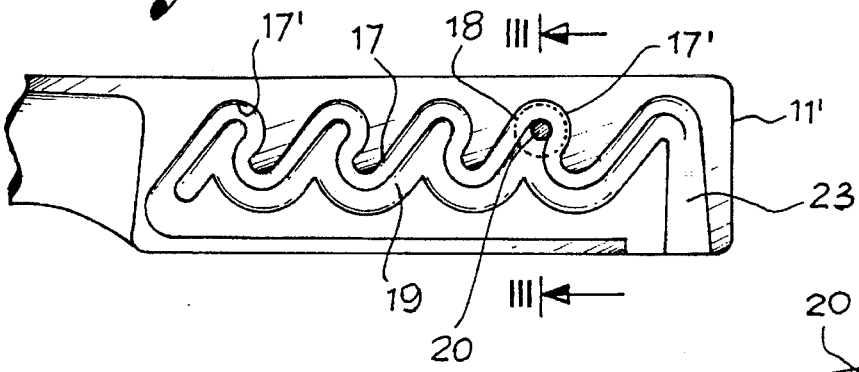
FIG. 2 is a sectional view of the positioning means according to section line II—II in FIG. 3.
Figure 4:
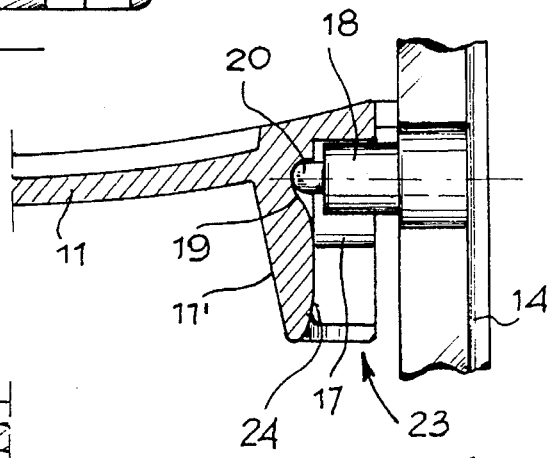
FIG. 4 is a sectional view similar to FIG. 3, but in proximity to an opening which receives the spring element designed to interact with the rack toothing.

The seat 11 is fitted with two side-members 11' provided with rack toothing 17 on their outer face—see FIG. 2—while the second pair of legs 14 supporting the back is provided with two locking pins 18—one for each leg—which are fixed facing the rack toothing 17, so as to pass through cavities 17' of the toothing and establish the various positions of the back and seat, and therefore the various conditions of use of the deck-chair.

Figure 3:
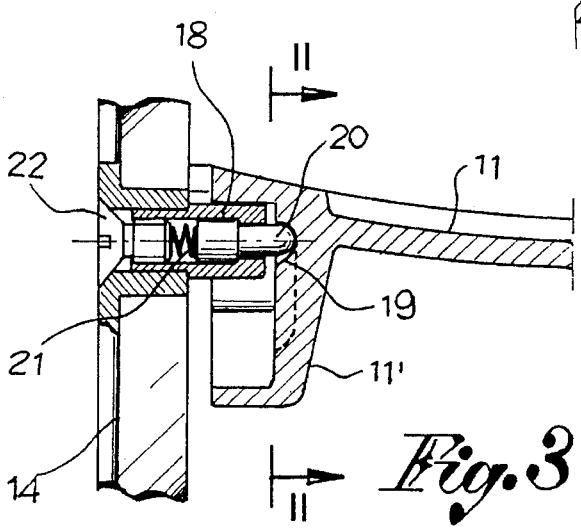
FIG. 3 is a sectional view according to line III—III in FIG. 2.

Now, according to the present invention, the outer face with rack of each side-member 11' of the seat 11 is provided with a groove 19—see FIGS. 2 and 3— which follows the outline of the toothing 17 and defines a guide path for the locking pin 18. Besides, said locking pin 18 carries a top spring element 20 which extends orthogonally, towards the side-member and is designed to pass through and follow the guide groove 19.

In the example shown herein, the spring element 20 comprises a small piston guided axially within pin 18 and stressed by a spring 21, which is kept in place by a screw 22, being the spring designed to push element 20 into the guide groove 19.

Nevertheless, always within the scope of this invention, the spring element 20 carried by the pin may have a different configuration or arrangement, or be stressed otherwise.

The spring element 20 of each locking pin 18 is forced to follow the groove 19 in proximity to the respective rack toothing, which ensures engagement of pin and rack and contemporarily favour positioning and stopping of the locking pin 18 in each of the cavities 17 defined by the toothing.

The spring pin 20 performs its action perpendicularly with respect to the plane of the rack and contemporarily—by acting in groove 19—it prevents any vertical displacement of the racks away from the respective locking pins, and therefore it ensures against independent lifting of the seat. However, the said configuration does not prevent normal positioning of the chair, which is possible by changing inclination of the back and seat and also depends on the different divarication of the legs.

It is also important to point out that, at one end of each rack 17, generally close to the back end of each side-member, the groove 19 is interrupted and provided with a passage 23 which allows disengagement of the seat from the locking pins 18 when it is necessary to fold and make the deck-chair more compact, and the passage of the pins towards the rack when the chair is opened in position of use. In proximity to each passage 23, an entrance chamfer 24 causes the recession of the spring element 20, which is loaded in order that it will click outwards into the guide groove when the locking pin achieves its level.

I claim:

1. A folding deck-chair, comprising a seat, a back and additional structure cooperating with said seat and back to provide a seat frame, one of said seat, back and said additional structure of said frame providing a first engaging part and another of said seat, back and additional structure of said frame providing a second engaging part;

rack toothings provided in two vertically disposed portions formed in or applied to two opposite sides of said first engaging part;

a locking pin provided on each of two opposite sides of said second engaging part, said locking pin passing through corresponding said rack toothings to establish one of various different positions of said back and said seat, corresponding to different positions of use of the deck-chair;

guide means for guiding said locking pin in a region adjacent to said rack toothings and for preventing displacement of said toothings away from said locking pin, said guide means including a guide groove provided adjacent to said toothings and following a contour of said toothings and a top spring element carried by said locking pin, said top spring element passing into said guide groove and following said guide groove, said spring element exerting a force urging said spring element into said guide groove, in a direction substantially perpendicular to said vertically disposed portions.

2. A folding deck-chair as claimed in claim 1, wherein the said spring element comprises piston member which is guided axially inside the locking pin and stressed by a spring kept in place by a screw, the spring designed to push the element into the guide groove.

3. A folding deck-chair as claimed in claim 1 or 2, wherein a passage is provided at one end of each rack toothing for allowing entrance/exit of the spring element of the locking pin into/out of guide groove.

4. A folding deck-chair as claimed in claim 3 wherein, in proximity to said passage, an entrance chamfer is provided on which the top spring element is displaced.

5. A folding deck-chair, comprising:

a first part including a first leg connected to a chair back;

a second part including a second leg connected to a chair seat;

rack toothings having a toothing contour, said rack toothings being connected to one of said first part and said second part;

a locking pin located on the other of said first part and said second part for engaging between teeth of said rack toothings to establish one of different positions of said back and seat frame parts, said different positions corresponding to different positions of use of the deck-chair;

guide means for guiding said locking pin relative to said toothings and for restricting displacement of said toothings away from said locking pin in a region of said rack toothings, said guide means including a guide groove provided following an outline of said teeth and a top spring element positioned partially in to said locking pin, said spring element engaging said guide groove, a passage being formed at one end of each rack toothing for allowing entrance/exit of said top spring element of said locking pin into out of said guide groove.

6. A folding deck-chair according to claim 5, wherein said first leg and said second leg are pivotally connected at a point.

7. A folding deck-chair, comprising:

a first part including a first leg connected to a chair back;

a second part including a second leg connected to a chair seat, said first leg and said second leg being pivotally connected at a point;

rack toothings having a toothing contour, said rack toothings being connected to one of said first part and said second part;

a locking pin located on the other one of said first part and said second part for engaging between teeth of said rack toothings to establish one of different positions of said back and seat frame parts, said different positions corresponding to different positions of use of the deck-chair;

guide means for guiding said locking pin relative to said toothings and for restricting displacement of said toothings away from said locking pin in a region of said rack toothings, said guide means including a guide groove which follows an outline of said teeth and a top spring element positioned partially, in said locking pin and urged into engagement with said guide groove, said top spring element including a piston member guided axially inside said locking pin and a spring acting on said piston member to push said piston member into engagement with said guide groove and a screw for maintaining a position of said spring.

* * * * *